US008858304B2

(12) United States Patent
Andonian

(10) Patent No.: US 8,858,304 B2
(45) Date of Patent: Oct. 14, 2014

(54) ADJUSTABLE CURVE HAND SANDER

(71) Applicant: Ashot H. Andonian, Tarzana, CA (US)

(72) Inventor: Ashot H. Andonian, Tarzana, CA (US)

( * ) Notice: Subject to any disclaimer, the term of this patent is extended or adjusted under 35 U.S.C. 154(b) by 93 days.

(21) Appl. No.: 13/658,819

(22) Filed: Oct. 24, 2012

(65) Prior Publication Data

US 2013/0109284 A1 May 2, 2013

Related U.S. Application Data

(60) Provisional application No. 61/551,436, filed on Oct. 26, 2011.

(51) Int. Cl.
*B24D 15/04* (2006.01)
*B24D 15/02* (2006.01)

(52) U.S. Cl.
CPC ..... *B24D 15/023* (2013.01)
USPC ..... 451/495; 451/523; 451/524; 451/525

(58) Field of Classification Search
CPC ..... B24B 23/005; B24D 15/02; B24D 15/023
USPC ..... 451/495, 458, 523–525
See application file for complete search history.

(56) References Cited

U.S. PATENT DOCUMENTS 1,618,604 A * 2/1927 Riggs ..... 407/29.11
1,707,207 A * 3/1929 Bianchi et al. ..... 407/29.11
1,927,574 A 9/1933 Parks
1,956,882 A 5/1934 Stowell
3,123,947 A 3/1964 Rawley
3,710,467 A * 1/1973 Coon et al. ..... 407/29.11
4,823,515 A 4/1989 Blome
5,459,928 A * 10/1995 Lynn et al. ..... 30/169
5,700,187 A * 12/1997 Balbi ..... 451/495
5,947,803 A 9/1999 Gruner
6,494,771 B2 12/2002 Carlson
6,575,822 B2 * 6/2003 Lowe et al. ..... 451/526
6,773,339 B2 * 8/2004 Cooper et al. ..... 451/495
7,048,618 B1 * 5/2006 Cramer ..... 451/59
7,553,221 B2 * 6/2009 Hope et al. ..... 451/495

* cited by examiner

*Primary Examiner* — Monica Carter
*Assistant Examiner* — Marcel Dion
(74) *Attorney, Agent, or Firm* — Martino Patent Law

(57) ABSTRACT

A hand-held sander for sanding a curved surface includes a structurally rigid frame having a left hand hold and left channel oppositely disposed from a right hand hold and right channel. An open-ended concave recess is formed between and perpendicular to the channels. A flexibly resilient and flat substrate has a left substrate end oppositely disposed from a right substrate end. The left substrate end is abutting and slidably captured within the left channel and the right substrate end is abutting and slidably captured within the right channel. A center adjustment knob is rotatably fixed to the frame having a female threaded end. A shaft is fixed to a center of the substrate and includes a male threaded end. The male threaded end of the shaft is configured to threadably engage the female threaded end of the knob, wherein rotation of the knob causes curvature of the substrate.

20 Claims, 6 Drawing Sheets

ADJUSTABLE CURVE HAND SANDER

CROSS-REFERENCE TO RELATED APPLICATIONS

This non-provisional patent application claims priority to provisional application 61/551,436 filed on Oct. 26, 2011 the contents of which are fully incorporated herein with this reference.

DESCRIPTION

1. Field of the Invention

The present invention generally relates to sanders. More particularly, the present invention relates to an adjustable curve hand sander.

2. Background of the Invention

During the manufacturing stage on a variety of goods, sanding is required to form a variety of surfaces or to simply smooth out an existing surface. Sanding is typically applied to a flat surface. A flat sander is relatively easy to apply to a flat surface. However, many times a curved surface is in need of sanding. A flat sander is not suited for easily sanding curved surfaces. It quickly becomes burdensome and problematic as there are not any curved sanders in the marketplace that are adjustable to a variety of curved surfaces.

Accordingly, many have attempted to solve the need for a curved sander but none of the previous sanders have become available or successful in the marketplace. U.S. Pat. No. 4,823,515 discloses a sander with a flexible membrane with opposing ends secured to spaced plates. This sander has no hand holds for use and is primarily intended just to sand model airplane wings.

U.S. Pat. No. 6,494,771 discloses a sander with a flexible membrane with a front and rear frame member permanently attached. A major problem with this sander is that when a user utilizes the device, unwanted forces are distributed into the different frame members that distort the flexible membrane. Pushing and pulling on the front and rear frame members impart uneven forces that flex the membrane. The curvature of the membrane must not be distorted when in use. U.S. Pat. No. 1,956,882 is very similar to U.S. Pat. No. 6,494,771, in that the forces exerted by the user are imparted onto the flexible membrane distorting its shape.

U.S. Pat. No. 7,553,221 discloses a concave sander that suffers from multiple problems. First, there is only one hand hold. In the applicant's experience, it is very hard to properly control a hand held sander without the use of two opposing grips for sufficient leverage and control. Second, the flexible membrane requires two separate adjustments to create a symmetrical curve. Making sure the curve is symmetrical becomes very hard as it is near impossible to eyeball the variances in symmetry along the membrane. Third, the sander requires special tools to adjust the screws which push on the flexible membrane.

Accordingly, there is a need for an adjustable curve hand held sander that is easy to use, has two grips for controlled use, has one adjustment mechanism that does not require the use of tools, and also naturally presents a symmetrical curve when adjusted to any curvature. There is a need for a sander that can create new curves as well as sand existing curves. There is a need for a single sander that can create a multitude of new curves. The present invention fulfills these needs and provides other related advantages.

SUMMARY OF THE INVENTION

An exemplary embodiment a hand-held sander for sanding a curved surface includes a structurally rigid frame having a left hand hold oppositely disposed from a right hand hold. A left channel is oppositely disposed from a right channel. An open-ended concave recess is formed between and perpendicular to the left and right channels. A flexibly resilient and flat substrate is defined as having a left substrate end oppositely disposed from a right substrate end. The left substrate end is abutting and slidably captured within the left channel and the right substrate end is abutting and slidably captured within the right channel. A center adjustment knob is rotatably fixed to the frame having a female threaded end. The knob is centered and disposed between the left hand hold and right hand hold. A shaft is fixed to a center of the substrate and includes a male threaded end. The male threaded end of the shaft is configured to threadably engage the female threaded end of the knob, wherein rotation of the knob by a user deforms the substrate to form a curvature. The deformation of the substrate is formed by shaft pulling at the center of the substrate and the left and right channels pushing the left and right substrate ends.

In other embodiments, the center adjustment knob includes a manual grip. This allows the sander to be toolless and not require the use of secondary tools.

The substrate may include a spring metal layer. The substrate may include a rubber layer bonded to the spring metal layer. The rubber layer may include a polyurethane elastomer.

The substrate may include a first side of a hook-and-loop style fastener attached to the rubber layer. The substrate may include a sanding layer having a second side of the hook-and-loop style fastener, wherein the first and second sides of the hook-and-loop style fastener are removably attached. The first side or second side of the hook-and-loop style fastener may include a plurality of relief gaps. Alternatively, an adhesively backed abrasive paper may be removably bonded to the substrate.

In another exemplary embodiment of the present invention, a left side adjustment mechanism may be disposed between the left hand hold and the left channel of the frame. Also, a right side adjustment mechanism may be disposed between the right hand hold and the right channel of the frame. The left side adjustment mechanism may include a left side knob attached to a left shaft. The left shaft may be rotatably and translatably coupled to the frame and extending inwards towards the open ended recess and abutting the left substrate end. Similarly, the right side adjustment mechanism may include a right side knob attached to a right shaft. The right shaft may be rotatably and translatably coupled to the frame and extending inwards towards the open ended recess and abutting the right substrate end.

In another exemplary embodiment of the present invention, a sander includes a structural frame having a left hand hold oppositely disposed from a right hand hold. A left guide channel is oppositely disposed from a right guide channel. An open-ended concave recess is formed between and perpendicular to the left and right guide channels. A collar is rotatably fixed to the structural frame centered between the left and right hand holds. The collar includes a female screw thread. A flexible pad supports a sanding medium on a front surface. The pad is defined as having a left pad end oppositely disposed from a right pad end. The left pad end is abutting and slidably captured within the left guide channel. The right pad end is abutting and slidably captured within the right guide channel. The flexible pad is fabricated from a resilient material so as to assume an essentially flat shape when the left and right pad ends are not acted on by external forces. A center threaded screw/rod/protrusion is fixed to a center of the flexible pad at one end and rotatably captured within the female screw thread of the collar at the other end.

A manual grip may be fixed to the collar. The flexible pad may include a spring metal layer bonded to an elastomer layer bonded to a first side of a hook-and-loop style fastener. A sand paper may include a second side of a hook-and-loop style fastener, wherein the first and second sides are removably attached.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
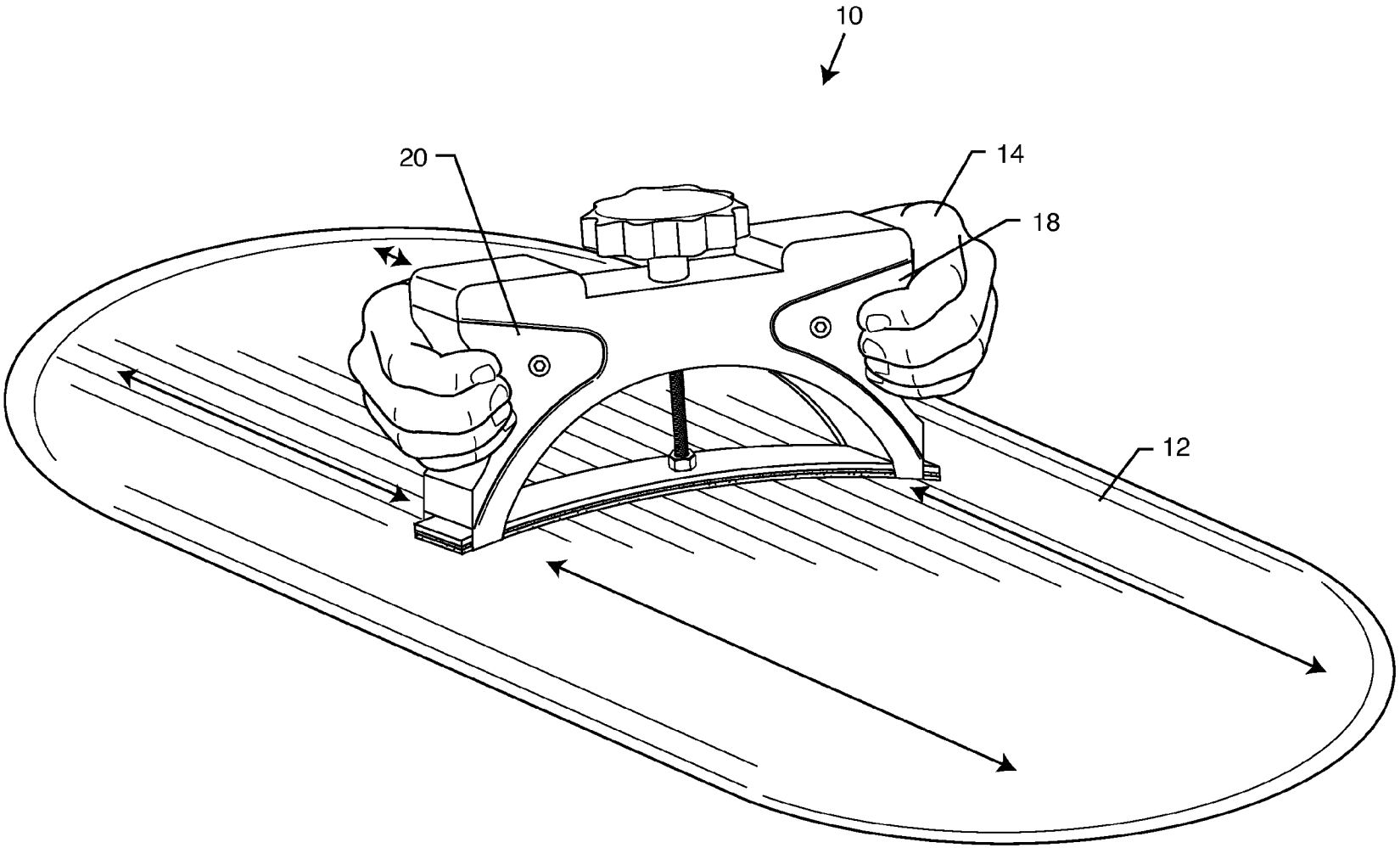
FIG. 1 is a perspective view of an exemplary sander embodying the present invention while in use sanding a curved surface.

FIG. 1 is a perspective view of an exemplary hand-held sander 10 embodying the present invention while in use sanding a curved surface 12. A user is able to grab the sander 10 with both hands 14 and move the sander 10 forwards and backwards. Utilizing two hands as opposed to one is very advantageous as significantly more control is possible when sanding. Sanding a piece of wood or material creates friction and drag as the tool is moved across the work piece. A sander utilizing only one hand is hard to control and manipulate as the sander moves or snags unwantingly. Allowing a second hand to also grab the tool provides a dramatic increase in efficiency and control of the sander 10 on the workpiece 12.

Figure 2:
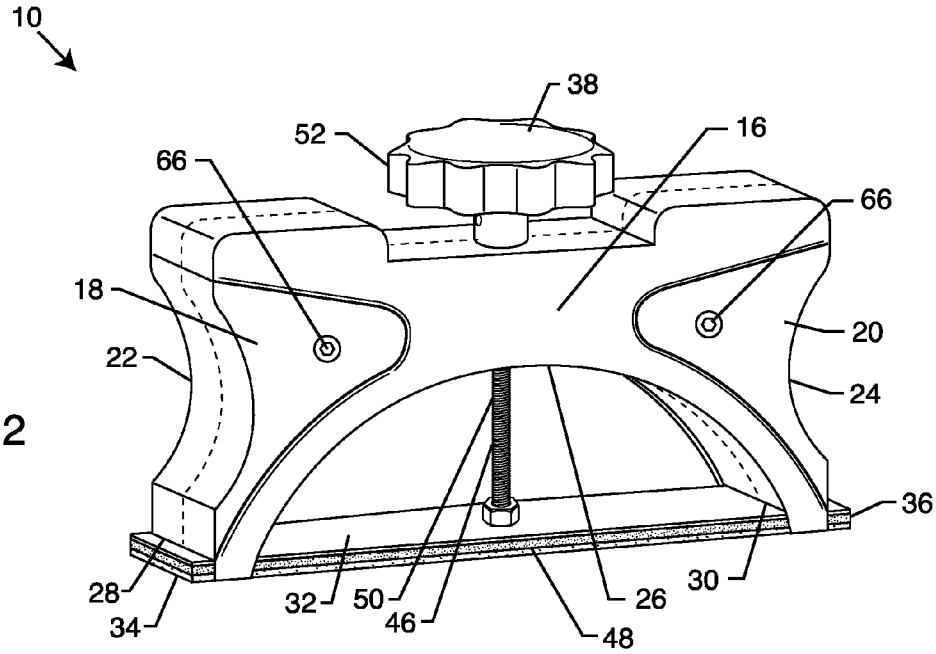
FIG. 2 is a perspective view of the exemplary sander of FIG. 1.

FIG. 2 is a perspective view of the hand-held sander 10 of FIG. 1. The sander 10 has a structurally rigid frame 16 comprising a left hand hold 18 oppositely disposed from a right hand hold 20. The structurally rigid frame 16 is sufficiently rigid and strong that it keeps it shape when in use. Therefore, the frame 16 may be made from a variety of materials including but not limited to wood, metal, plastic, carbon fiber, composites, a combination thereof and other various materials.

As can be seen by one skilled in the art, the left side 22 and right side 24 may be interchangeable as the sander 10 is symmetrically configured. In other embodiments not shown, the tool may be unsymmetrically shaped to better fit into the left and right hands.

The frame 16 has an open-ended concave recess 26 formed along the bottom and between the left side 22 and the right side 24. The recess 26 is formed and connects between a left channel 28 and a right channel 30. A flexibly resilient and flat substrate/pad 32 is defined as having a left substrate end 34 oppositely disposed from a right substrate end 36.

As can be seen, the left substrate end 34 is abutting and slidably captured within the left channel 28. Furthermore, the right substrate end 36 is abutting and slidably captured within the right channel 30. The left channel 28 and right channel 30 keep the substrate 32 from moving when the sander 10 is in use such as was depicted in FIG. 1.

Figure 3:
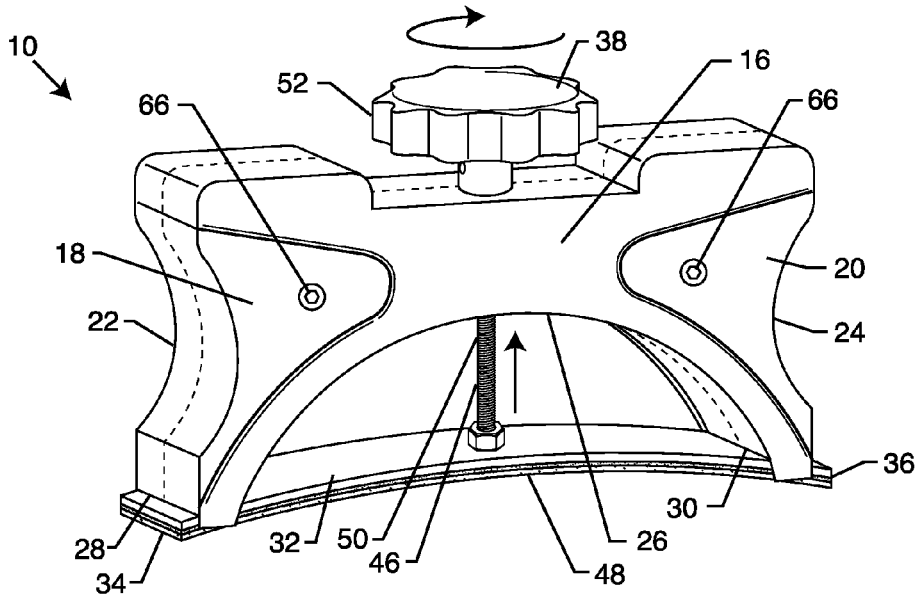
FIG. 3 is a perspective view similar to FIG. 2 now showing knob rotation and the corresponding curvature of the sanding pad.

FIG. 3 is a perspective view similar to FIG. 2 now showing a center adjustment knob 38 rotating and the corresponding curvature of the sanding pad 32. The center adjustment knob 38 is rotatably fixed to the frame 16. Skipping ahead to FIG. 7 which is a sectional perspective view of the structure of FIGS. 1-6, the knob 38 also includes a female threaded end 40. As shown here, a collar 42 has the female threaded end 40. The collar 42 and the knob 38 are fixedly secured together. This securement may be through a bond, adhesive, fastener or a set screw 44 as shown herein. It is to be understood by one skilled in the art that the knob 38 and collar 42 could be formed as one piece or as several pieces.

Referring back to FIGS. 2 and 3, a shaft 46 is fixed to a center 48 of the substrate 32 and has a male threaded end 50. The male threaded end 50 of the shaft 46 is configured to threadably engage the female threaded end 40 of the knob 38 or collar 42. As FIG. 3 shows, rotation of the knob 38 by a user deforms the substrate 32 to form a curvature. The deformation of the substrate 32 is formed by shaft 46 pulling at the center 48 of the substrate 32 and the left 28 and right channels 30 pushing the left 34 and right substrate ends 36.

An elegant aspect of this inventive design is that the substrate ends 34 and 36 slide along the channels 28 and 30. When the curvature of the substrate/pad 32 occurs, the ends 34, 36 are also pulled inwards a small amount. Allowing the ends 34, 36 to be captured yet not fixed within the channels 28, 30 allows them to slightly translate/move such that no binding or unwanted curvature of the substrate 32 occurs.

The knob 38 also includes a manual grip 52. The grip 52 is designed to be toolless. This means that no additional secondary tools are needed to adjust the curvature of the substrate/pad 32. This allows the sander 10 to be user friendly and allows changes to made quickly to the curvature. Also, using only one knob 38 simplifies the operation of the sander 10 and ensure a symmetrical curvature.

Figure 4:
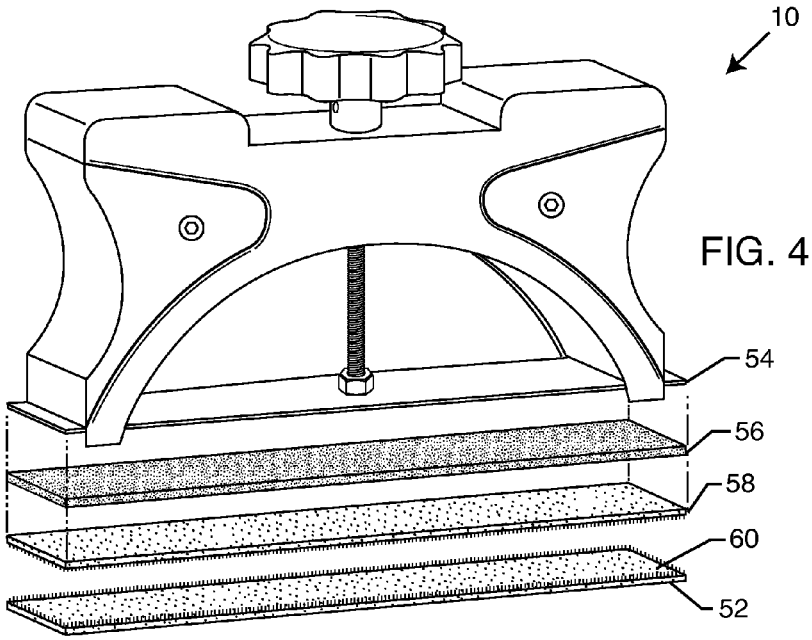
FIG. 4 is a perspective view similar to FIG. 2 now showing an exploded view of the sanding pad.
Figure 5:
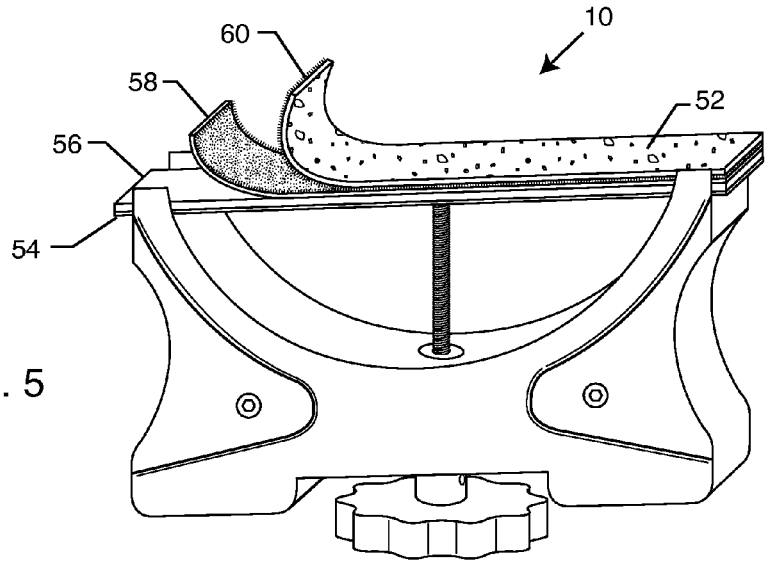
FIG. 5 is a bottom perspective view of the structure of FIGS. 1-4 showing the bonding of sand paper to the sanding pad.

FIG. 4 is a perspective view similar to FIG. 2 now showing an exploded view of the sanding substrate/pad 32. FIG. 5 is a bottom perspective view of the structure of FIGS. 1-4 showing the bonding of sand paper 52 to the sanding pad 32. The substrate/pad 32 is sufficiently resilient and flexible such that it returns to its shape when not in its forced curvature. Said differently, the flexible pad 32 is fabricated from a resilient material so as to assume an essentially flat shape when the left and right pad ends 34, 36 are not acted on by external forces. As can be seen by one skilled in the art, there are many ways of accomplishing a flexibly resilient pad 32. As shown here, the substrate 32 has a spring metal layer 54. Additionally, a rubber layer 56 may be bonded to the spring metal layer 54. The spring metal layer 54 and the rubber layer 56 act as one when they are bonded or formed together. The rubber layer 56 may comprises a polyurethane elastomer or other suitable material.

To facilitate easy attachment of sand paper 52, the substrate/pad 32 may also include a first side of a hook-and-loop style fastener 58 attached to the rubber layer 56. Then, the sand paper 52 has a corresponding second side of the hook-and-loop style fastener 60. Therefore, the first 58 and second sides 60 of the hook-and-loop style fastener are removably attached in a quick and easy way. As an alternative method, the sand paper 52 may simply have an adhesive that is used to bond to the rubber layer 56. As another alternative method, the substrate 32 may have the sand paper 52 permanently formed therein as a single unit.

The rubber layer 56 is important in that it helps to distribute forces and loads evenly over the sand paper 52. Furthermore, the rubber layer 56 or polyurethane elastomer 56 is important in that it does not permanently deform. In the Applicant's experience, the rubber layer 56 should not be made from a plastic layer or any other material that can be easily permanently deformed. When a plastic layer is bent, the plastic layer does not want to return to a truly flat shape. Forces are imparted into the plastic layer that prevent it from returning to its original shape. This means that the sanding pad 32 will not be flat after it has been bent when plastic is used. The spring metal layer 54 and the rubber layer 56 both return to a flat and natural state as if any curvature was never present.

Figure 6:
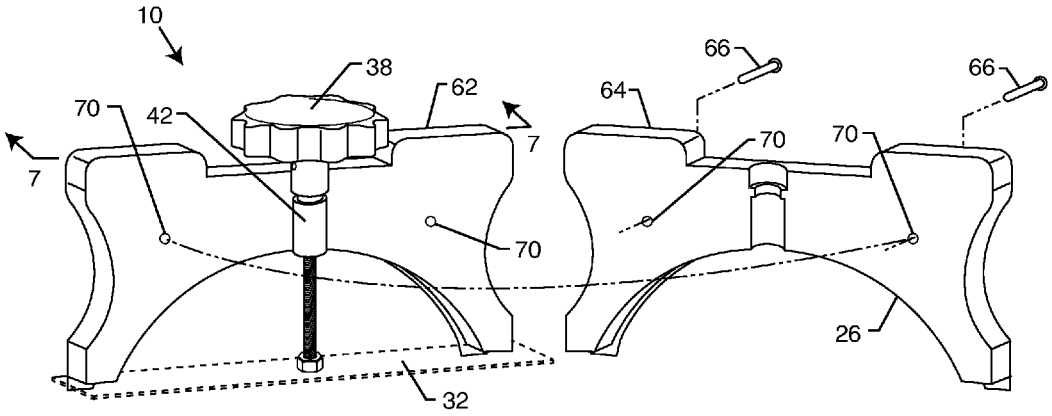
FIG. 6 is an exploded perspective view of the structure of FIGS. 1-5 showing how the sander can be assembled.
Figure 7:
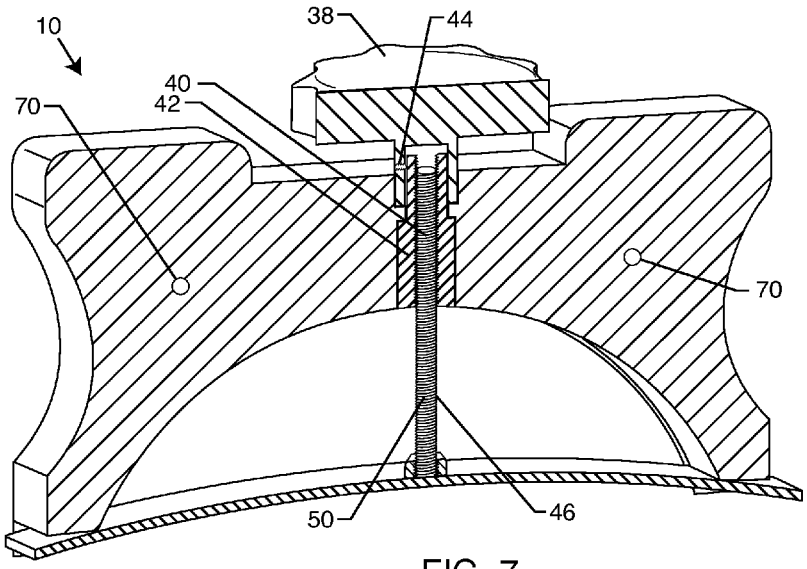
FIG. 7 is a sectional perspective view of the structure of FIGS. 1-6.

FIG. 6 is an exploded perspective view of the structure of FIGS. 1-5 showing how the sander 10 can be assembled. In this view the sander 10 is made from a first half 62 and a second half 64. The collar 42 and knob 38 are captured between the halves when they are assembled together. This allows the collar 42 and knob 38 to rotate but not to translate. The two halves may be secured together through a fastener 66 that goes through the holes 70. In this particular embodiment, the fastener 66 is a hex drive screw but could be any suitable fastener 66 known by one skilled in the art. Alternatively, the two halves 62 and 64 may be permanently bonded or adhered together.

One advantage of the present invention is that the substrate/pad 32 is fully supported by the frame 16. Then, the left hand hold 18 and right hand hold 20 are supported as part of the frame 16. This means that when a user is working the sander 10, unwanted forces are not imparted onto the pad 32. This means that the pad 32 retains its set curvature when in use and produces a true curve free from distortion. Furthermore, the use of one adjustment knob 38 in the center of the frame 16 means that the curvature formed by the pad 32 is symmetrical. This is accomplished by allowing the left end of the substrate 34 and the right end of the substrate 36 to abut and be freely captured by the left channel 28 and the right channel 30. This simple yet novel design produces a symmetrical curvature that is easy to adjust and is easy to use which none of the prior art realized, taught or suggested.

Figure 8:
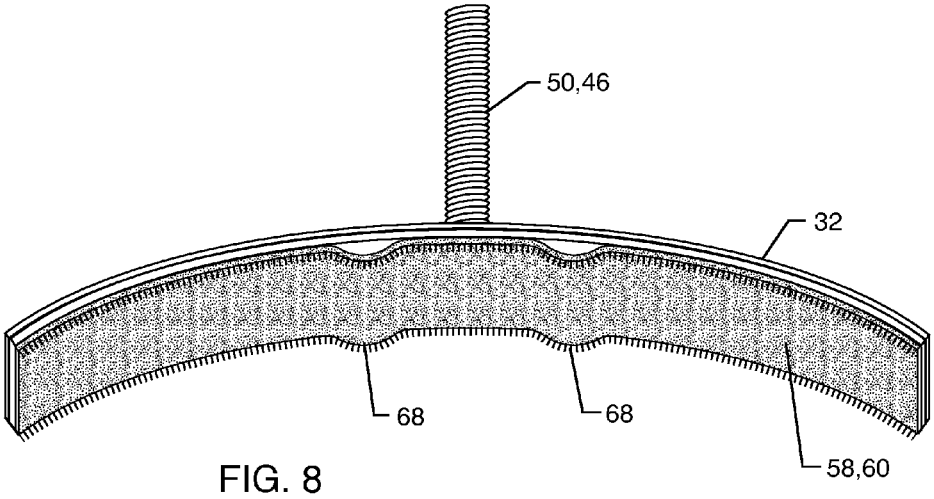
FIG. 8 is a bottom perspective view of a sanding pad assembly with buckling.

FIG. 8 is a bottom perspective view of a sanding pad 32 with buckling. As the curvature of the substrate 32 deepens, the hook-and-loop style fastener may buckle and bulge 68 in various locations. This is because the material is being compressed onto itself and has no capacity to relieve the build up of stress.

Figure 9:
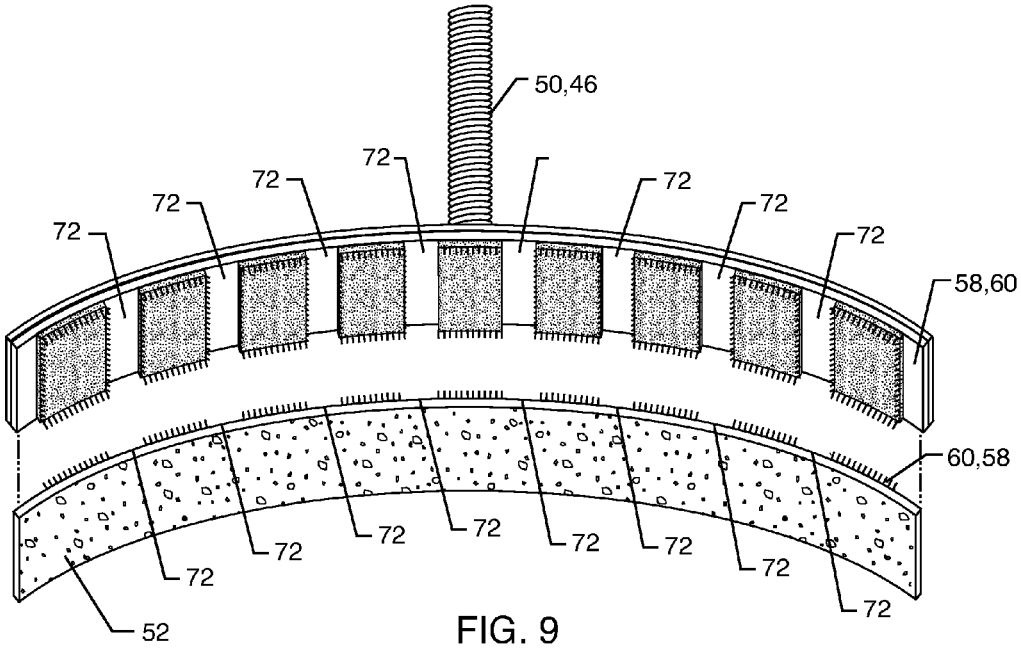
FIG. 9 is a bottom perspective view of an exemplary sanding pad eliminating buckling.

FIG. 9 is a bottom perspective view of an exemplary sanding pad 32 eliminating buckling. The first or second side of the hook-and-loop style fastener 58,60 comprises a plurality of relief gaps 72. The relief gaps 72 may be formed on either the substrate 32 or the sand paper 52, or both.

Figure 10:
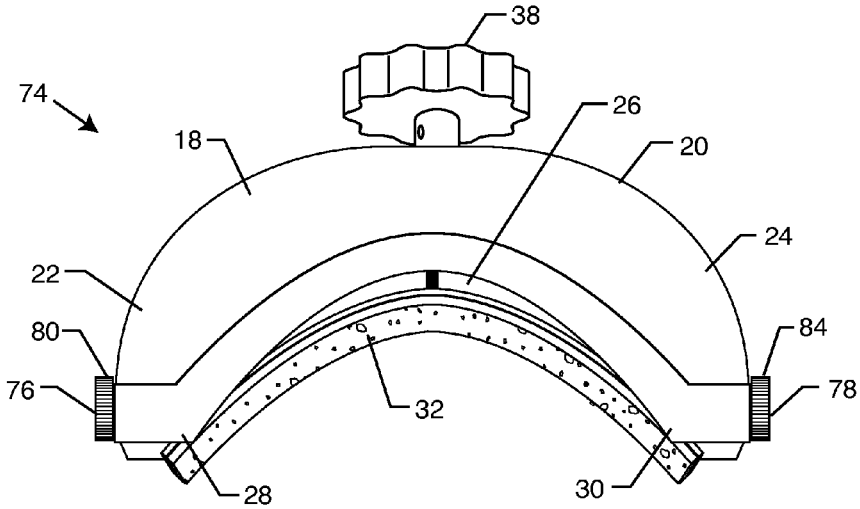
FIG. 10 is a side perspective view of another exemplary sander embodying the present invention now including side adjustment knobs.
Figure 11:
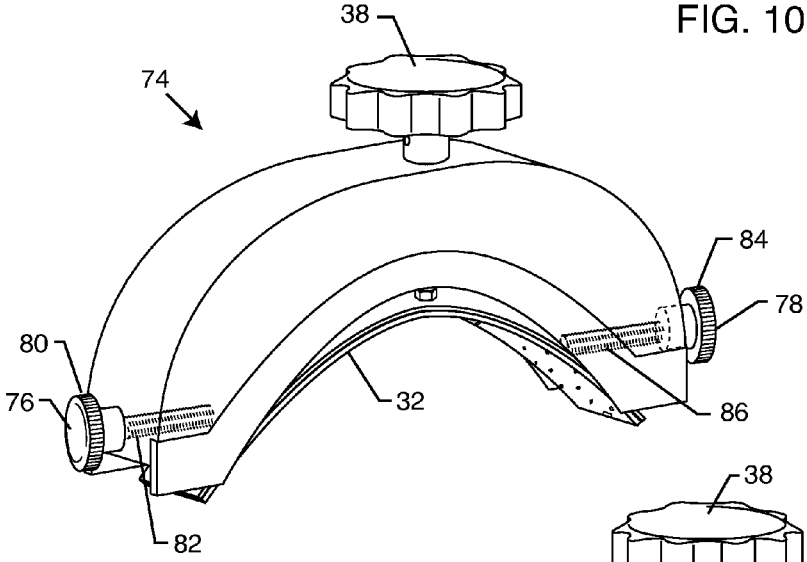
FIG. 11 is a left perspective view of the structure of FIG. 10.
Figure 12:
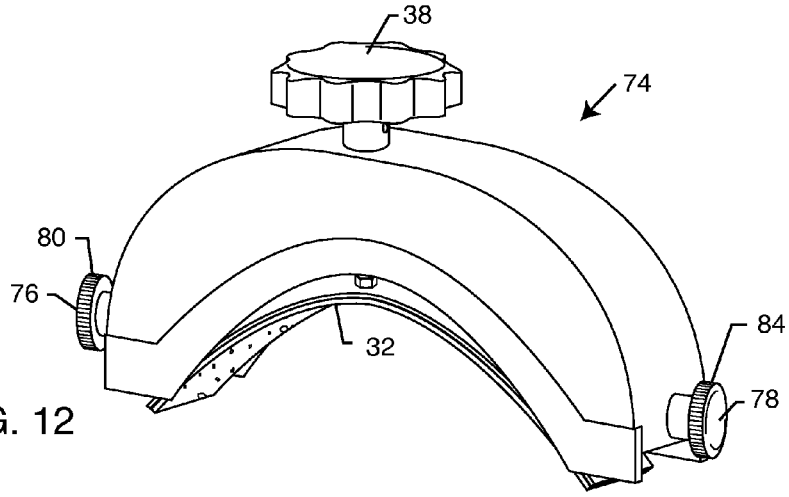
FIG. 12 is a right perspective view of the structure of FIG. 10.

FIGS. 10-12 are perspective views of another exemplary sander 74 of the present invention. The sander 74 is very similar to the sander 10 previously discussed, now with the addition of more adjustments. A left side adjustment mechanism 76 disposed between the left hand hold 18 and the left channel 28 of the frame 16. A right side adjustment mechanism 78 disposed between the right hand hold and the right channel of the frame. The left side adjustment mechanism 76 comprises a left side knob 80 attached to a left shaft 82. The left shaft is rotatably and translatably coupled to the frame 16 and extends inward towards the open ended recess 26 and abutting the left substrate end 34. The right side adjustment mechanism 78 comprises a right side knob 84 attached to a right shaft 86. The right shaft is rotatably and translatably coupled to the frame 16 and extends inward towards the open ended recess 26 and abutting the right substrate end 36. Therefore, the two knobs 80 and 84 may be rotated to push the substrate 32 into non-symmetrical shapes or other various curved shapes that are desired.

Although several embodiments have been described in detail for purposes of illustration, various modifications may be made to each without departing from the scope and spirit of the invention. Accordingly, the invention is not to be limited, except as by the appended claims.

What is claimed is:

1. A hand-held sander for sanding a curved surface, comprising:

a structurally rigid frame comprising a left hand hold oppositely disposed from a right hand hold, a left channel oppositely disposed from a right channel, and an open-ended concave recess formed between and perpendicular to the left and right channels;

a flexibly resilient and flat substrate defined as comprising a left substrate end oppositely disposed from a right substrate end, wherein the left substrate end is abutting and slidably captured within the left channel and wherein the right substrate end is abutting and slidably captured within the right channel;

a center adjustment knob rotatably fixed to the frame comprising a female threaded end, the knob centered and disposed between the left hand hold and right hand hold; and a shaft non-rotatably fixed to a center of the substrate and comprising a male threaded end, wherein the male threaded end of the shaft is configured to threadably engage the female threaded end of the knob, wherein rotation of the knob by a user deforms the substrate to form a curvature.

2. The sander of claim 1, wherein the deformation of the substrate is formed by the shaft pulling at the center of the substrate and the left and right channels pushing the left and right substrate ends.

3. The sander of claim 1, wherein the center adjustment knob comprises a manual grip.

4. The sander of claim 1, wherein the center adjustment knob is toolless.

5. The sander of claim 1, wherein the substrate comprises a spring metal layer.

6. The sander of claim 5, wherein the substrate comprises a rubber layer bonded to the spring metal layer.

7. The sander of claim 6, wherein the rubber layer comprises a polyurethane elastomer.

8. The sander of claim 6, wherein the substrate comprises a first side of a hook-and-loop style fastener attached to the rubber layer.

9. The sander of claim 8, wherein the substrate comprises a sanding layer having a second side of the hook-and-loop style fastener, wherein the first and second sides of the hook-and-loop style fastener are removably attached.

10. The sander of claim 8, wherein the first side of the hook-and-loop style fastener comprises a plurality of relief gaps.

11. The sander of claim 6, including an adhesively backed abrasive paper removably bonded to the substrate.

12. The sander of claim 1, including a left side adjustment mechanism disposed between the left hand hold and the left channel of the frame, and including a right side adjustment mechanism disposed between the right hand hold and the right channel of the frame.

13. The sander of claim 12, wherein the left side adjustment mechanism comprises a left side knob attached to a left shaft, the left shaft rotatably and translatably coupled to the frame and extending inwards towards the open ended recess and abutting the left substrate end, and wherein the right side adjustment mechanism comprises a right side knob attached to a right shaft, the right shaft rotatably and translatably coupled to the frame and extending inwards towards the open ended recess and abutting the right substrate end.

14. A hand-held sander for sanding a curved surface, comprising:

a structurally rigid frame comprising a left hand hold oppositely disposed from a right hand hold, a left channel oppositely disposed from a right channel, and an open-ended recess formed between and perpendicular to the left and right channels;

a flexibly resilient and flat substrate defined as comprising a left substrate end oppositely disposed from a right substrate end, wherein the left substrate end is abutting and slidably captured within the left channel and wherein the right substrate end is abutting and slidably captured within the right channel, and wherein the substrate comprises a spring metal layer bonded to a polyurethane elastomer layer, the polyurethane elastomer layer bonded to a first side of a hook-and-loop style fastener;

a center adjustment knob rotatably fixed to the frame comprising a female threaded end, the knob centered and disposed between the left hand hold and right hand hold, wherein the knob comprises a manual grip; and a shaft non-rotatably fixed to a center of the substrate and comprising a male threaded end, wherein the male threaded end of the shaft is configured to threadably engage the female threaded end of the knob, wherein rotation of the knob by a user deforms the substrate to form a curvature where deformation of the substrate is formed by the shaft pulling at the center of the substrate and the left and right channels pushing the left and right substrate ends.

15. The sander of claim 14, wherein the substrate comprises a sanding layer having a second side of the hook-and-loop style fastener, wherein the first and second sides of the hook-and-loop style fastener are removably attached.

16. The sander of claim 14, wherein the first side of the hook-and-loop style fastener comprises a plurality of relief gaps.

17. The sander of claim 14, including an adhesively backed abrasive paper removably bonded to the substrate.

18. A sander, comprising:

a structural frame comprising a left hand hold oppositely disposed from a right hand hold, a left guide channel oppositely disposed from a right guide channel, and an open-ended concave recess formed between and perpendicular to the left and right guide channels;

a collar rotatably fixed to the structural frame centered between the left and right hand holds, the collar comprising a female screw thread;

a flexible pad for supporting a sanding medium on a front surface, the pad defined as comprising a left pad end oppositely disposed from a right pad end, wherein the left pad end is abutting and slidably captured within the left guide channel and wherein the right pad end is abutting and slidably captured within the right guide channel, wherein the flexible pad is fabricated from a resilient material so as to assume an essentially flat shape when the left and right pad ends are not acted on by external forces; and a center threaded protrusion non-rotatably fixed to a center of the flexible pad at one end and rotatably captured within the female screw thread of the collar at the other end.

19. The sander of claim 18, including a manual grip fixed to the collar.

20. The sander of claim 19, wherein the flexible pad comprises a spring metal layer bonded to an elastomer layer bonded to a first side of a hook-and-loop style fastener, and including a sand paper comprising a second side of a hook-and-loop style fastener, wherein the first and second sides are removably attached.

* * * * *